US012474134B2

(12) United States Patent
Köysüren

(10) Patent No.: US 12,474,134 B2
(45) Date of Patent: Nov. 18, 2025

(54) ERGONOMIC RIFLE WITH A MECHANISM HOLDER

(71) Applicant: UTAŞ SAVUNMA SANAYI VE TICARET ANONIM ŞIRKETI, Antalya (TR)

(72) Inventor: Muhammet Serkan Köysüren, Antalya (TR)

( * ) Notice: Subject to any disclaimer, the term of this patent is extended or adjusted under 35 U.S.C. 154(b) by 0 days.

(21) Appl. No.: 18/867,052

(22) PCT Filed: May 18, 2023

(86) PCT No.: PCT/TR2023/050457
§ 371 (c)(1),
(2) Date: Nov. 19, 2024

(87) PCT Pub. No.: WO2023/229560
PCT Pub. Date: Nov. 30, 2023

(65) Prior Publication Data

US 2025/0334367 A1 Oct. 30, 2025

(30) Foreign Application Priority Data

May 25, 2022 (TR) ..... 2022/008500

(51) Int. Cl.
*F41A 17/36* (2006.01)
*F41A 3/54* (2006.01)
*F41C 7/00* (2006.01)

(52) U.S. Cl.
CPC ..... *F41A 17/36* (2013.01); *F41A 3/54* (2013.01); *F41C 7/00* (2013.01)

(58) Field of Classification Search
CPC ..... F41A 17/34; F41A 17/36; F41A 17/40; F41A 3/54; F41A 3/56; F41C 7/00
See application file for complete search history.

(56) References Cited

U.S. PATENT DOCUMENTS 2,325,395 A * 7/1943 Hammond ..... F41A 17/36 89/138
9,091,499 B2 7/2015 Overstreet et al.
(Continued)

FOREIGN PATENT DOCUMENTS

DE 2523716 A * 12/1976
EP 2045562 B1 12/2013

OTHER PUBLICATIONS

International Search Report for corresponding PCT/TR2023/050457 dated Aug. 18, 2023.
(Continued)

*Primary Examiner* — Gabriel J. Klein
(74) *Attorney, Agent, or Firm* — Egbert, McDaniel & Swartz, PLLC

(57) ABSTRACT

A rifle has a body, a magazine slot, a handle, a lower mechanism movable between primary and secondary positions in the direction of the barrel extension to drive bullets into the barrel and a monoblock rifle mechanism having an upper mechanism extending over the barrel of the rifle. A primary lock slot is provided on the upper mechanism, and a secondary lock slot on the barrel. One end of a main arm is rotatably connected to the barrel. A button is connected to the main arm so that the user can move the main arm. When the button is pushed from the barrel towards the upper mechanism, if the rifle mechanism is retracted, it will snap into the primary lock slot. If the rifle mechanism is retracted, it includes a mechanism stopper with a lock lever that fits into the primary lock slot and prevents the rifle mechanism from moving.

7 Claims, 7 Drawing Sheets

(56) References Cited

U.S. PATENT DOCUMENTS

| | | | | |
|---|---|---|---|---|
| 9,354,014 | B2 | 5/2016 | Swadener et al. | |
| 9,599,419 | B2 | 3/2017 | McGinty | |
| 10,197,353 | B2 | 2/2019 | Lewis et al. | |
| 2009/0249672 | A1* | 10/2009 | Zedrosser | F41A 17/36 42/6 |
| 2010/0300278 | A1* | 12/2010 | Zedrosser | F41A 3/68 89/180 |
| 2017/0160026 | A1* | 6/2017 | Walther | F41A 35/06 |
| 2017/0160032 | A1 | 6/2017 | Overstreet et al. | |
| 2017/0234638 | A1* | 8/2017 | Noonan | F41A 17/36 89/138 |
| 2020/0263944 | A1 | 8/2020 | Harris et al. | |
| 2022/0373282 | A1* | 11/2022 | Cheng | F41A 17/36 |

OTHER PUBLICATIONS

Written Opinion of the International Searching Authority for corresponding PCT/TR2023/050457 dated Aug. 18, 2023.

* cited by examiner

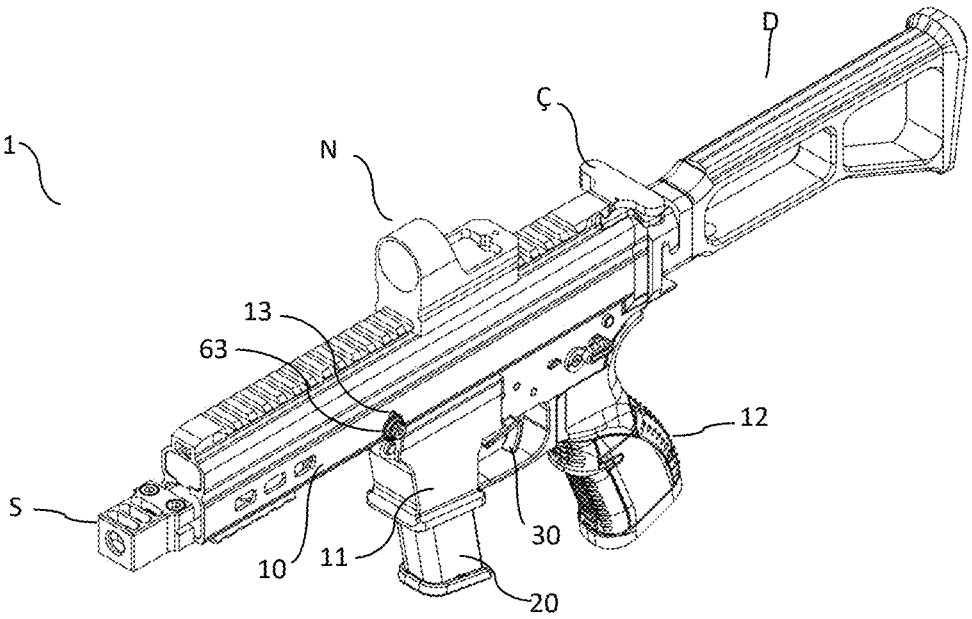
FIGURE 1
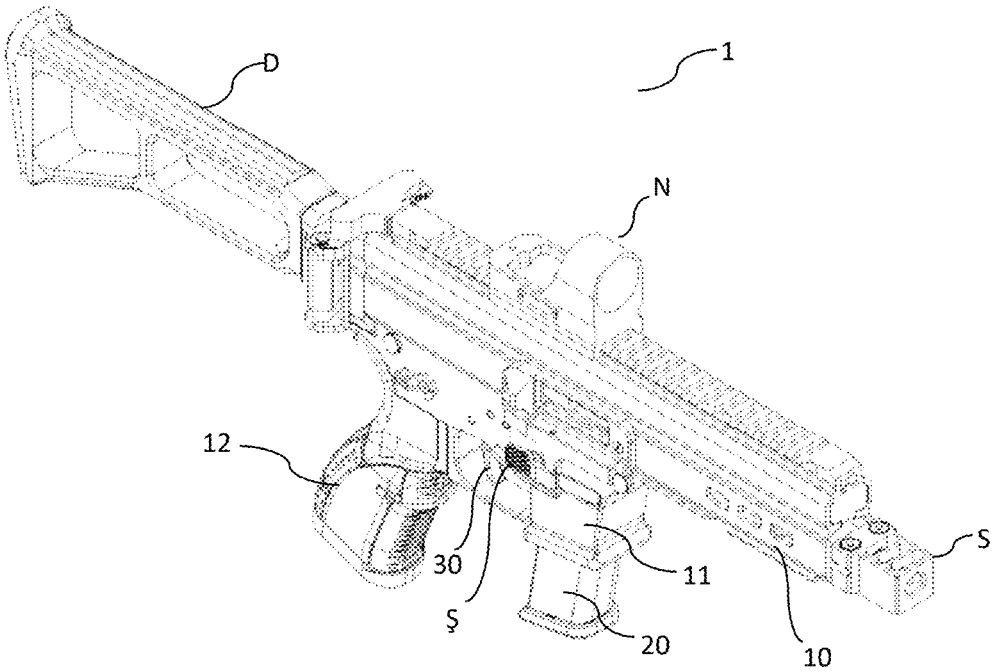
FIGURE 1.A

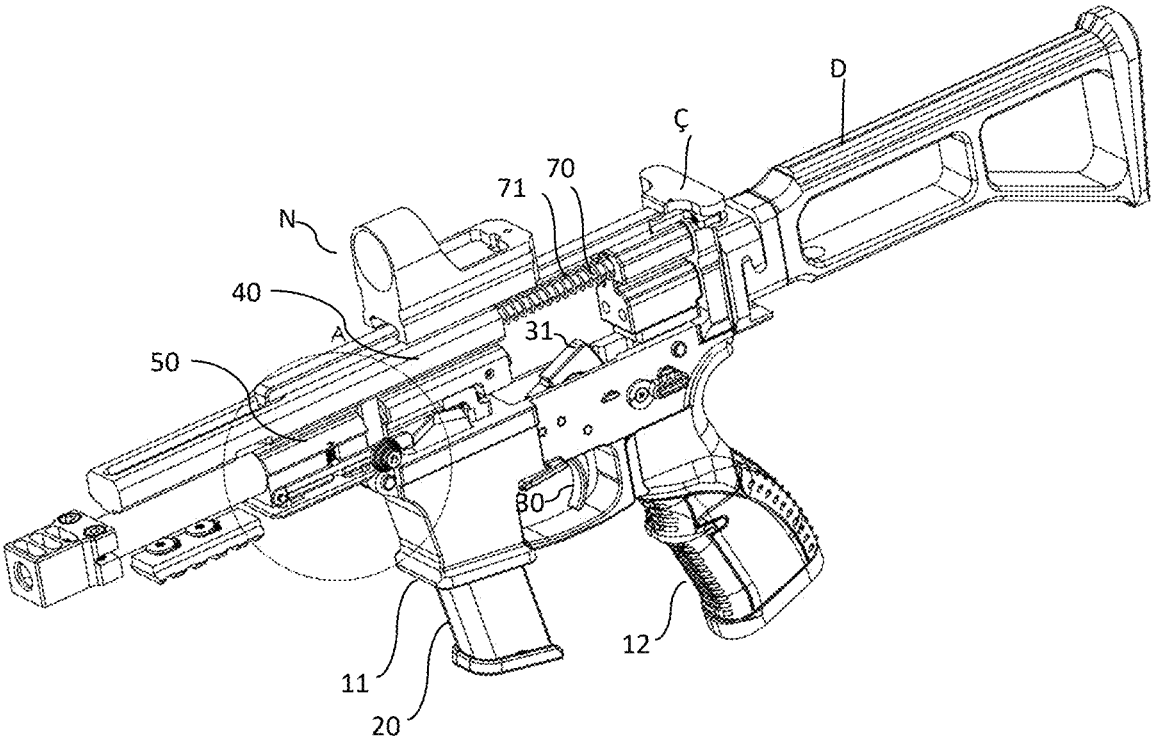
FIGURE 2
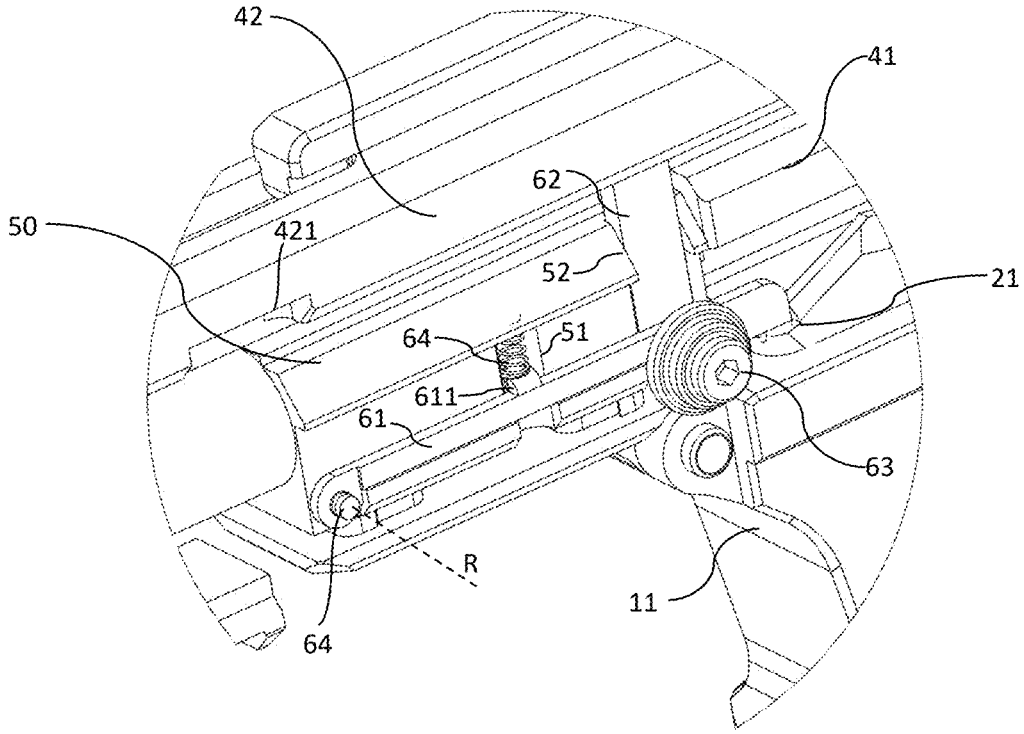
FIGURE 2.A

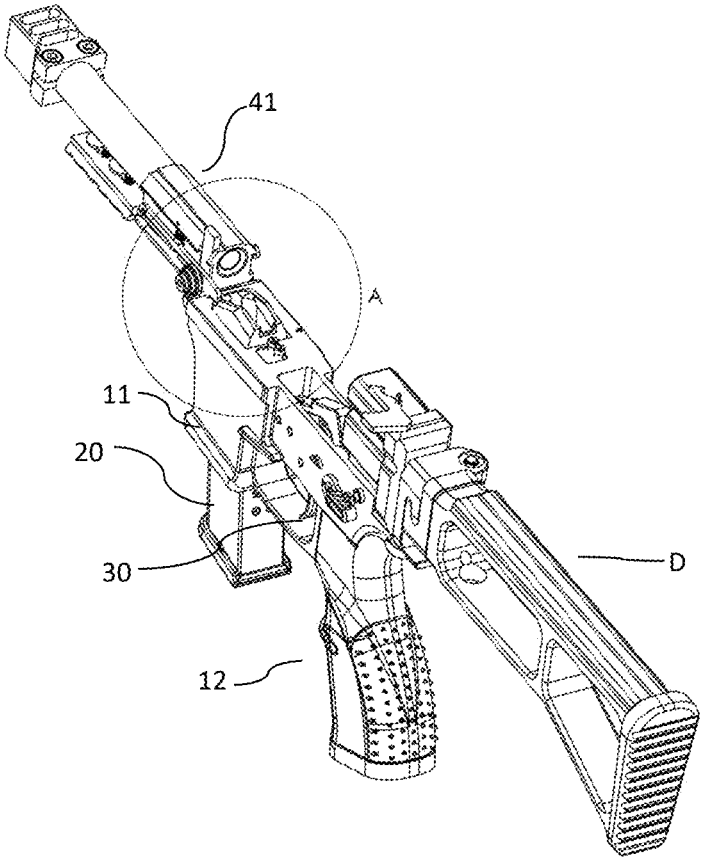
FIGURE 2.B
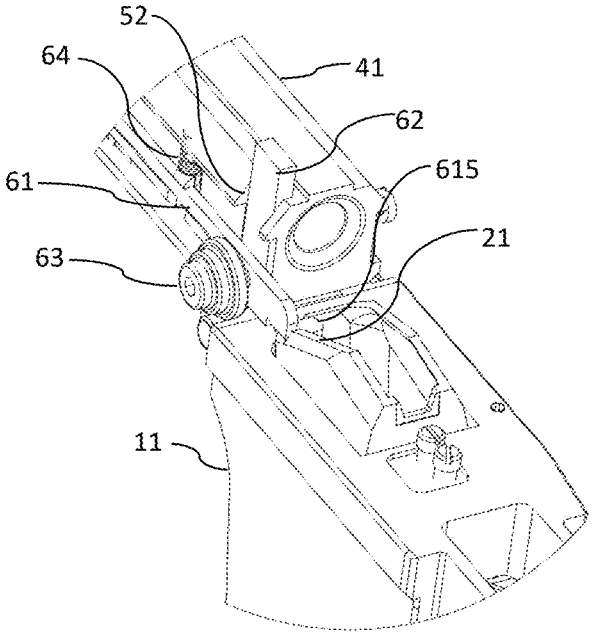
FIGURE 2.C

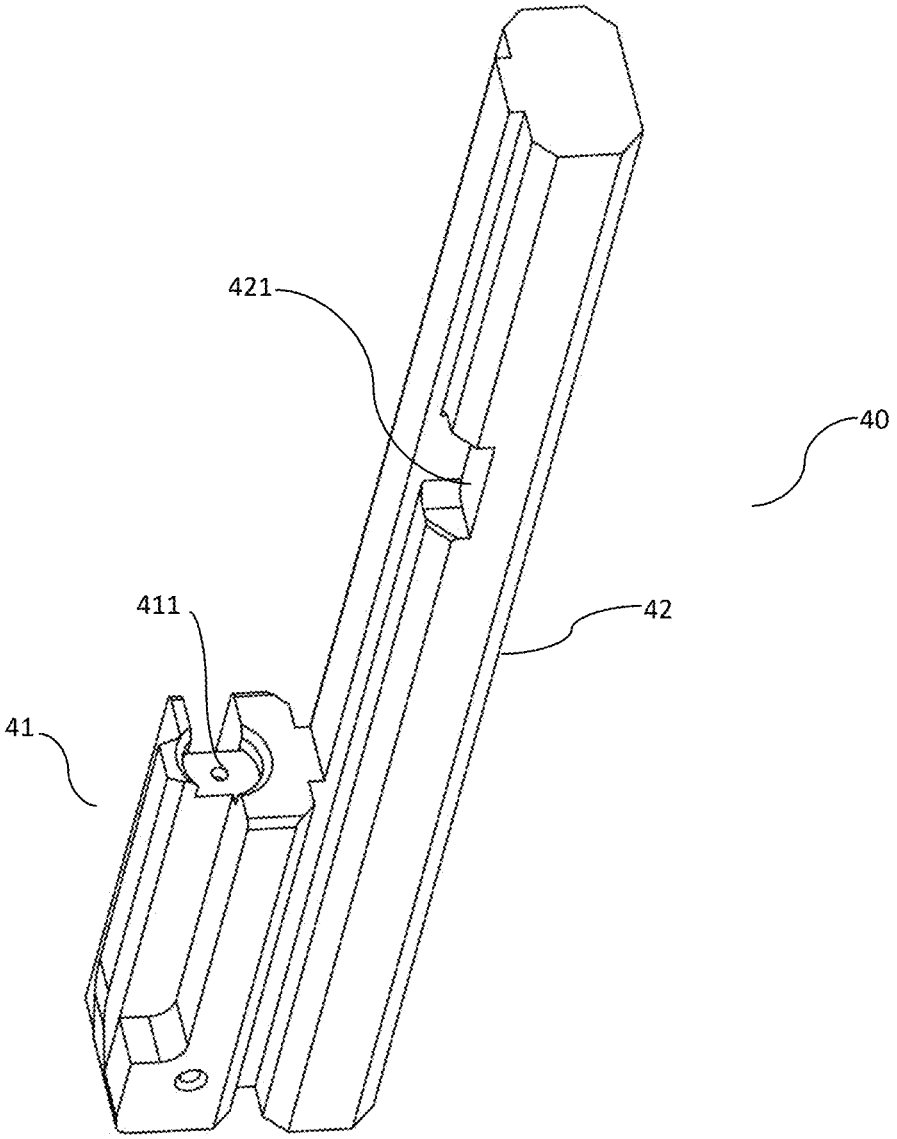
FIGURE 2.D

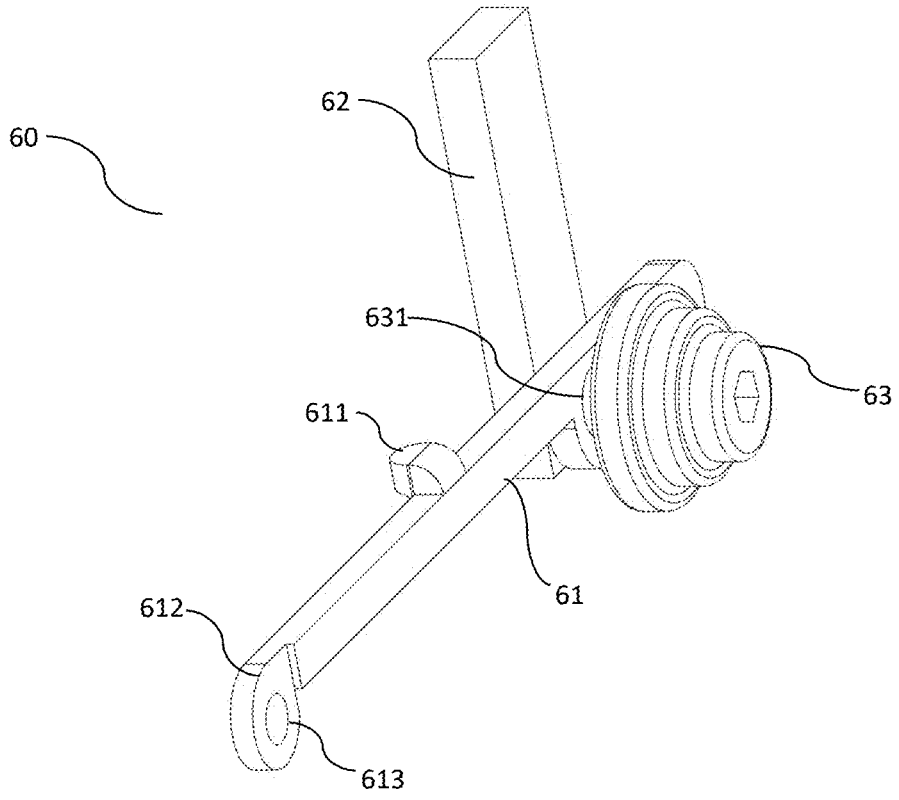
FIGURE 3
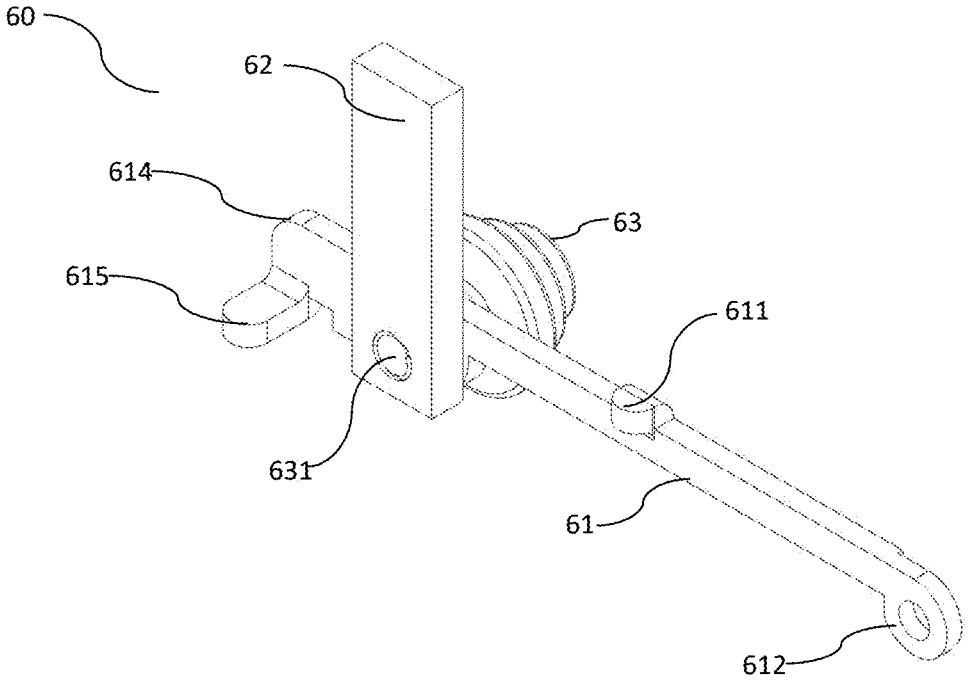
FIGURE 3.A

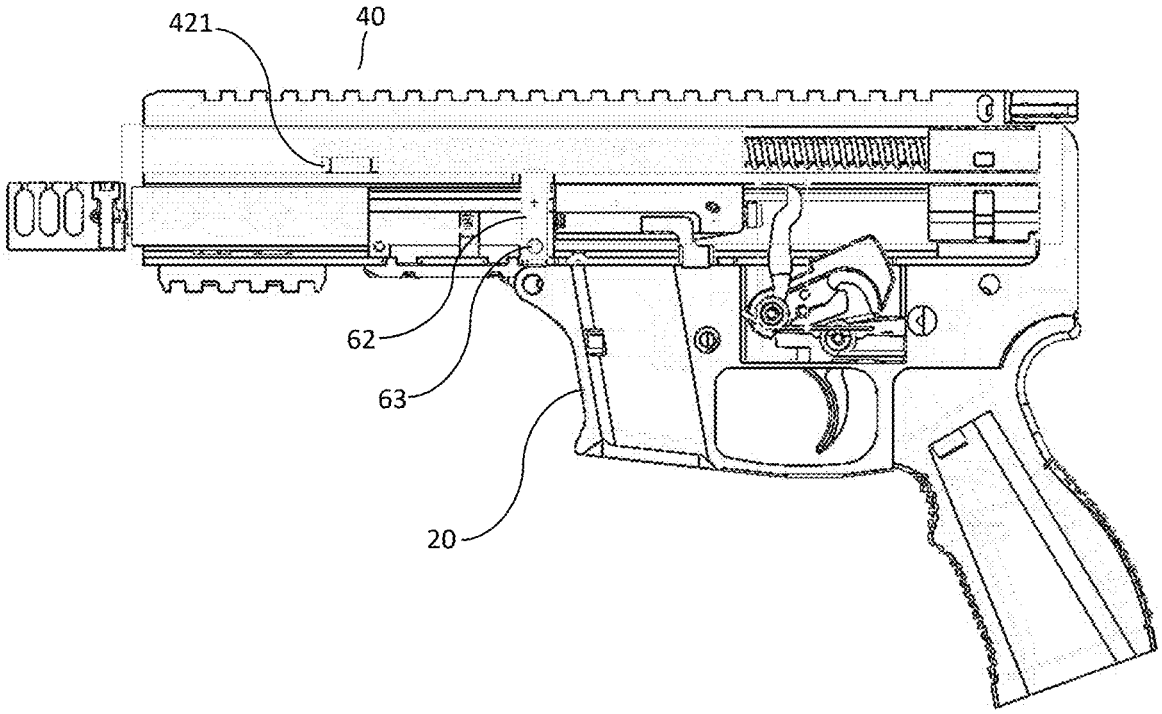
FIGURE 4.A

ERGONOMIC RIFLE WITH A MECHANISM HOLDER

TECHNICAL AREA

The invention relates to a rifle with a mechanism holder that can lock and unlock the rifle mechanism that drives the cartridge into the barrel in hunting and defense rifles.

PRIOR ART

For a magazine change in hunting and defense rifles, the mechanism must first be stopped and then the magazine is removed by pressing the magazine handle. The mechanism, also known as the "bolt", drives the bullets in the magazine into the barrel. In conventional rifles, the mechanism moves linearly in the direction of the rifle. In customary mechanisms, there is a mechanism carrier and a movable pusher inside the mechanism carrier that drives the bullet into the barrel with linear motion. In addition, it is known in systems that drive the bullet into the barrel with a single movement, which is in one piece, known as monoblock.

The mechanism for ignition pushes the bullet, which is pushed out of the magazine by the magazine follower, into the barrel. Then, when the trigger is pressed, the firing pin in the mechanism is pushed and detonates the bullet. Thus, it allows it to move out of the barrel. Here the mechanism is pushed back in the rifle by the effect of firing. Here the mechanism is pushed back in the rifle by the effect of firing. Then, the spring connected to the back of the mechanism pushes the mechanism again and drives the next bullet into the barrel. This movement continues without interruption and therefore the mechanism must be stopped to change the magazine.

Mechanism stoppers known as "bolt catch" are used to keep the mechanism behind after firing the last cartridge in the magazine. After the last cartridge is fired, the mechanism gets in front of the stopper mechanism and leaves the mechanism behind with the lifting of the tensioner in the magazine.

As can be seen in the patents U.S. Pat. Nos. 9,354,014B2, 9,091,499B2, EP2045562B1 and U.S. Pat. No. 9,599, 419B2, the button that drives the mechanism stopper is in the position between the part of the magazine facing the rifle body and the trigger. During use, one hand of the user is on the grip and the other hand it is in the fore-end around the barrel. The user has to change the position of her hand or use her finger to push the mechanism stop button. This is not an ergonomic situation. However, as seen in the patent examples above, the position of the button cannot be changed due to the structure of the mechanism stopper.

As a result, all the problems mentioned above have made it necessary to make an innovation in the related field.

OBJECTIVE OF THE INVENTION

The present invention aims to eliminate the above-mentioned problems and to make a technical innovation in the related field.

The main purpose of the invention, the aim is to reveal new mechanism holder structure that allows a more ergonomic a button positioning that can lock and unlock the rifle mechanism, especially the monoblock rifle mechanism, that drives the cartridges into the barrel in hunting and defense rifles.

BRIEF DESCRIPTION OF THE INVENTION

The present invention has been set forth in order to achieve all the above-mentioned objectives and which will emerge from the detailed description below. The invention, a body; a magazine slot where the magazine is placed; a handle; a sub-mechanism movable between the primary and secondary position in the muzzle extension direction to drive the bullets into the muzzle and is a rifle comprising a monoblock rifle mechanism with an upper mechanism extending over said barrel.

Accordingly the present invention, a primary lock slot on said upper mechanism; a secondary lock slot on said barrel; a main arm with one end rotatably connected to the barrel; a button connected to said main arm so that the user can move the main arm; connected to the main arm mentioned and passing through the secondary lock slot and when the button is pushed from the barrel to the upper mechanism, if the rifle mechanism is retracted, it fits into the primary lock slot and includes a mechanism holder with a lock lever that prevents the rifle mechanism from moving.

Thus, a mechanism holder that can be positioned more ergonomically is obtained.

In a preferred embodiment of the invention, the other end of the said main arm is provided to press from the end of the magazine follower facing the barrel.

Thus, it will be possible to take the said mechanism holder to the front part and the user can control the mechanism holder without changing the position of the hand holding the magazine or the barrel.

Another preferred embodiment of the invention contains a planar printhead of the end pressing the magazine follower.

A preferred embodiment of the invention includes a spring seat on the said barrel and a spring inside the said spring seat that pushes the main arm away from the barrel.

Another preferred embodiment of the invention includes a spring projection on which the spring will be placed on the said main arm.

A preferred embodiment of the invention includes a button pin connecting said main lever, lock lever and button.

Another preferred embodiment of the invention is provided in such a way that the mentioned button and the barrel are at the same level.

BRIEF DESCRIPTION OF THE FIGURES

In FIG. 1 shows the isometric view of the rifle that is the subject of the invention.

In FIG. 1.A. another isometric view of the rifle that is the subject of the invention is given.

In FIG. 2, the isometric view of the rifle in FIG. 1 is given without the upper body.

FIG. 2.A is a detailed view of the rifle showing the upper and lower mechanisms and their relative positions.

FIG. 2.B shows the isometric view of the rifle in FIG. 2 without the upper mechanism.

In FIG. 2.C, the detail view of the lower mechanism and mechanism holder in FIG. 2.B is given.

In FIG. 2.D the isometric view of the rifle mechanism is given.

In FIG. 3 shows the isometric view of the mechanism holder.

In FIG. 3.A another isometric view of the mechanism holder is given.

FIG. 4.A is a cross-sectional view of a pistol showing the mechanism as embodied in a pistol, including the primary lock slot, lock lever, button and magazine.

Drawings do not necessarily need to be scaled and details not necessary for understanding the present invention may be omitted. Furthermore, elements that are at least substantially identical or have at least substantially identical functions are denoted by the same number.

EXPLANATION OF REFERENCE NUMBERS IN THE FIGURES

Figure 4:
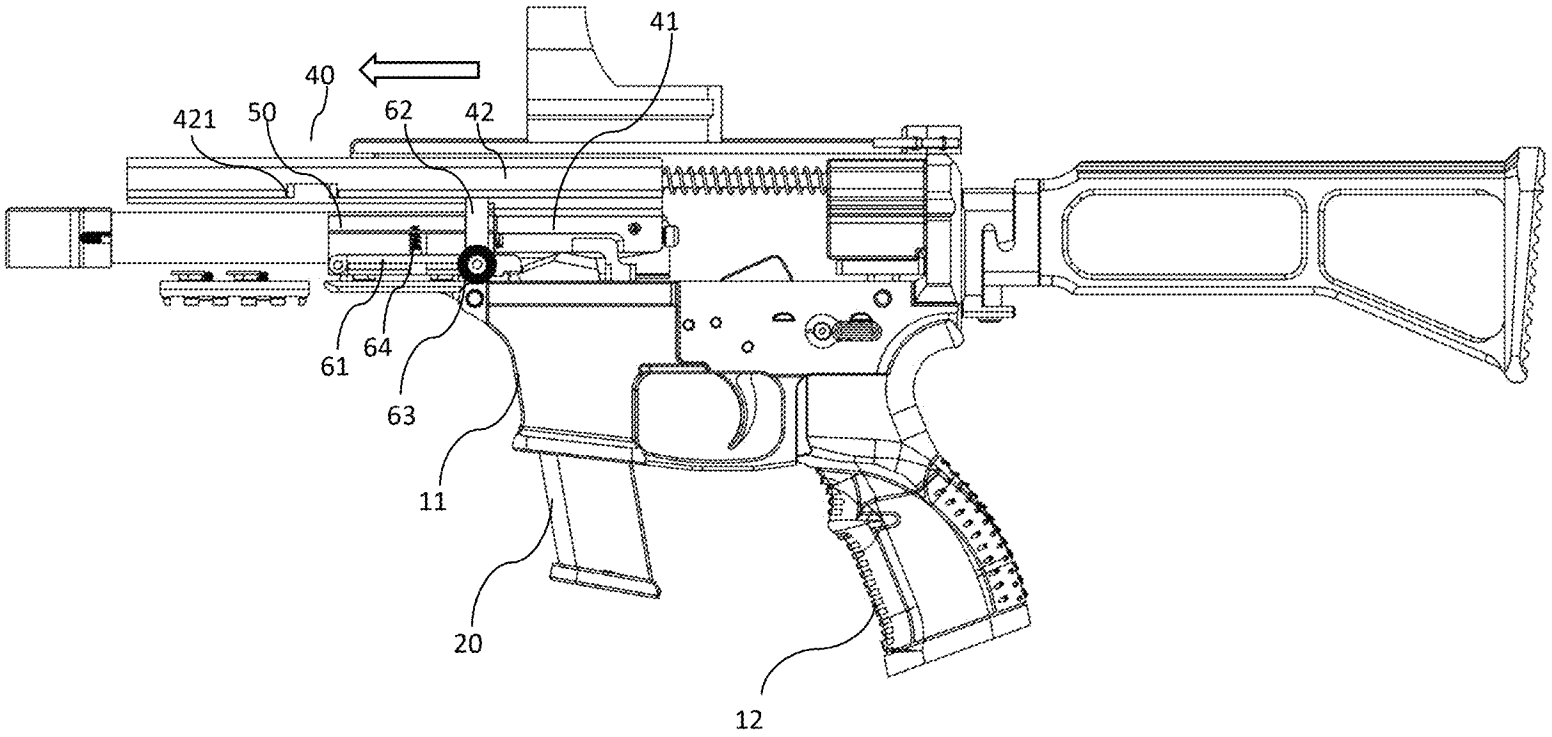
In FIG. 4 shows the side view of FIG. 2.

1. Rifle
- 10. Body
- 11. Magazine slot
- 12. Handle
- 13. Slot
- 20. Magazine
- 21. Magazine follower
- 30. Trigger
- 31. Striker (horoz)
- 40. Rifle mechanism
- 41. Lower mechanism
  - 411. Pin slot
- 42. Upper mechanism
  - 421. Primary lock slot
- 50. Barrel
- 51. Arrow slot
- 52. Secondary lock slot
- 60. Mechanism stopper
- 61. Main arm
  - 611. Spring protrusion
  - 612. Connection terminal
  - 613. Connection clearance
  - 614. Thrust terminal
  - 615. Thrust head
- 62. Lock lever
- 63. Button
  - 631. Button pin
- 64. Spring
- 65. Holder pin
- 70. Damping arm
- 71. Damping spring Ç. Pull handle
D. Gunstock
N. Sight
S. Suppressor
Ş. Magazine button
R. Axis of rotation

DETAILED DESCRIPTION OF THE INVENTION

In this detailed explanation, the rifle (1) with an ergonomic mechanism holder (60), which is the subject of the invention, is explained with examples that will not create any limiting effect only for better understanding of the subject.

The subject of the invention relates to a rifle (1) with a mechanism holder (60) that can lock and unlock the rifle mechanism (40) that drives the bullets into the barrel (50) in hunting and defense rifles (1).

With reference to FIGS. 1 and 1.A; the rifle (1) that is the subject of the invention is structured on a body (10). The firing mechanism of the said rifle (1) is positioned in this body (10). There may be a gunstock (D) on the back of the body (10), a sight (N) on the upper part, and a suppressor (S) on the front part. Preferably these elements are provided interchangeably.

There is a handle (12) extending from the lower part of the body (10) and arranged for a user to hold the rifle (1). A magazine slot (11) where the magazine (20) will be placed is positioned on the said body (10). Between the magazine slot (11) and the handle (12), there is a trigger (30) arranged to fire the rifle (1) and associated with the firing elements in the body (10). Said ignition elements are known in the art.

There is a magazine button (Ş) on the side of the body (10), preferably on the right side. Said magazine button (Ş) provides locking and unlocking of the magazine (20) placed in the magazine slot (11). Its use and structure are known in the art.

A longitudinal slot (13) is positioned on the side of the body (10), preferably on the left side. A button (63) that drives the mechanism stopper (60) extends out of the said slot (13). The button (63) can move along the slot (13). Preferably and as the most ergonomic solution, the slot (13) is positioned to remain between the barrel (50) and the magazine slot (11) according to the direction of the barrel (50).

FIGS. 2 and 2.A show the position where a bullet has been driven into the barrel (50). The barrel (50) is fixedly connected to the end of the body (10). The rifle mechanism (40) is positioned to move linearly to the rear of the barrel (50). The rifle mechanism (40) moves between the trigger (30) and the barrel (50). Rifle mechanism (40) has been contacted on the body (10) damping arm (70) provided in the form of a shaft and a helical damping spring (71) fitted over said damping arm (70).

As can be seen in FIGS. 2.A and 2.D, the rifle mechanism consists of two parts, the lower mechanism (41) and the upper mechanism (42). Said lower and upper mechanism (41, 42) move together. They are preferably monolithic. Both the lower mechanism (41) and the upper mechanism (42) are arranged to extend in the direction of the barrel.

While the lower mechanism (41) contacts the barrel (50) while the bullet is being driven into the barrel (50), the upper mechanism (42) remains on the barrel (50). Upper mechanism (42) is longer than lower mechanism (41). When the rifle mechanism (40) is fully retracted, that is, allowing the bullet to exit the magazine (20), it still lies above the barrel (50).

A pin slot (411) is arranged inside the lower mechanism (41). A firing pin (not shown in the figures) is located inside the pin slot (411). When the rifle mechanism (40) drives the bullet into the barrel (50), the striker (31) driven by the trigger (30) pushes the firing pin and makes it contact the bullet. This is how the bullet is fired.

Preferably, there is a channel in the upper part of the rifle mechanism (40). By connecting a pull handle (Ç) to the said channel, the user can manually pull the rifle mechanism in question.

Referring to FIGS. 2.A, 3 and 3.A; a mechanism holder (60) is arranged between the said barrel (50) and the magazine holder (11). The mechanism holder (60) includes a main arm (61) extending in the direction of the barrel (50) in such a way that it remains on the side. It comprises a lock lever (62) perpendicular to the said main arm (61) and a button (63) connecting the main arm and lock levers (61, 62) to each other. The button (63) includes a button pin (631), which passes through both the main arm (61) and the lock lever (62). As mentioned before, the button (63) extends out of the slot (13) on the body (10).

The main arm (61) is connected to the barrel (50) by a holder pin (65) from one end, especially as can be seen in FIG. 2.A. Here, the main arm (61) is rotatably connected to the barrel (50) with respect to a rotation axis (R) passing through the center of the holder pin (65). Accordingly, the connection end (612), which has a connection opening (613), is connected on the main arm (61) for the holder pin (65) to pass.

The other end of the main arm (61) to press edited as can be seen in FIGS. 2.B and 2.C, the magazine follower of the magazine (20). For this reason, there is a thrust head (615) at this end.

A arrow slot (51) and secondary lock slot (52) are arranged on the barrel (50). A spring (64) is placed inside the said arrow slot (51) with one end pressing the ceiling of this slot and the other end pressing the main arm (61). Based on this, a spring protrusion (611) is arranged on the main arm (61) and said spring (64) is placed on this protrusion.

The aforementioned lock lever (62) passes through the secondary lock slot (52). The lock lever (62) extends towards the upper mechanism (42) part of the rifle mechanism (40). As can be seen in FIG. 2.D, a primary lock slot (421) is located at the bottom of the upper mechanism (42). The primary lock slot (421) aligns with the lock lever (62) when the rifle mechanism (40) are fully retracted. When the lock lever (62) is pushed towards the upper mechanism (42) by means of the button (63), the lock lever (62) fits into the primary lock slot (421).

With reference to FIGS. 4 and 4.A; As explained before, the bullets are driven into the barrel (50) by the lower mechanism (41) with the movement of the rifle mechanism (40) in the direction of the arrow in FIG. 4. It is ignited by driving the firing pin. Then the rifle mechanism (40) moves in the opposite direction of the arrow and is pulled over the magazine (20). Magazine follower pushes the upper one of the bullets in the magazine (20) in front of the rifle mechanism (40). Here, as the rifle mechanism (40) compresses the damping spring (71) while retracting, it moves in the direction of the arrow and drives the new bullet back into the barrel (50). This process occurs repeatedly until the trigger (30) is released in automatic rifles (1). In single-shot rifles (1), it continues each time the trigger (30) is pressed.

The button (63) of the mechanism stopper (60) where the rifle mechanism (40) is desired to be locked is pushed in the direction of the arrow in FIG. 4.A while the rifle mechanism (40) is retracted. Said pushing action enables the lock lever (62) to fit into the primary lock slot (421). In this case, the rifle mechanism (40) remains motionless until the said lock lever (62) is pulled back in the opposite direction of the arrow by means of the button (63).

The scope of protection of the invention is specified in the attached claims and cannot be limited to what is described in this detailed description for exemplary purposes. Because it is clear that a person skilled in the art can present similar embodiments in the light of what has been described above without departing from the main theme of the invention.

The invention claimed is:

1. A rifle comprising:

a body;

a magazine slot in which a magazine is placed;

a handle;

a monoblock rifle mechanism having a lower mechanism movable between a primary position and a secondary position in a direction of a barrel extension to drive bullets into the barrel and an upper mechanism extending over said barrel;

a primary lock slot on said upper mechanism;

a secondary lock slot on said barrel;

a main arm, one end of which is rotatably connected to the barrel, a button connected to said main arm so that a user can move the main arm;

a mechanism stopper with a lock lever connected to said main arm and passing through the secondary lock slot, said mechanism stopper configured to snap into the primary lock slot, if the monoblock rifle mechanism is retracted away from the barrel, when the button is pushed from the barrel towards the upper mechanism, wherein the lock lever fits into the primary lock slot and prevents the monoblock rifle mechanism from moving.

2. The rifle according to claim 1, wherein another end of said main arm is provided to press from an end of a magazine follower.

3. The rifle according to claim 2, wherein a tip presses the magazine follower and includes a thrust head.

4. The rifle according to claim 1, comprising an arrow slot on said barrel and a spring inside said arrow slot that pushes the main arm away from the barrel.

5. The rifle according to claim 4, wherein said main arm includes a spring protrusion on which a spring will be placed.

6. The rifle according to claim 1, wherein said main arm, said lock lever, and said button are connected to each other by a button pin.

7. The rifle according to claim 1, wherein said button is aligned with the barrel.

* * * * *